United States Patent [19]

Maa et al.

[11] 4,338,184

[45] Jul. 6, 1982

[54] COAL CONVERSION IN THE PRESENCE OF ADDED ALKALI METAL COMPOUNDS

[75] Inventors: Peter S. Maa, Baytown; Lavanga R. Veluswamy; Charles J. Vadovic, both of Houston, all of Tex.

[73] Assignee: Exxon Research & Engineering Co., Florham Park, N.J.

[21] Appl. No.: 200,710

[22] Filed: Oct. 27, 1980

[30] Foreign Application Priority Data

Oct. 26, 1979 [JP] Japan ..... 54-139028

[51] Int. Cl.[3] ..... C10G 1/00; C10G 1/06; B01J 37/00

[52] U.S. Cl. ..... 208/10; 208/8 LE; 252/425

[58] Field of Search ..... 252/425; 208/10, 8 LE

[56] References Cited

U.S. PATENT DOCUMENTS 3,030,297 4/1962 Schroeder ..... 208/8

3,375,175 3/1968 Eddinger et al. ..... 201/31

3,796,650 3/1974 Urban ..... 208/10

4,222,849 9/1980 Shimizu ..... 252/425 X

FOREIGN PATENT DOCUMENTS 2020691 11/1979 United Kingdom .

OTHER PUBLICATIONS

"Hydrogenation of Coal in the Batch Autoclave", Hawk et al., Bulletin 622, Bureau of Mines 1965.

*Primary Examiner*—Delbert E. Gantz
*Assistant Examiner*—William G. Wright
*Attorney, Agent, or Firm*—Yale S. Finkle

[57] ABSTRACT

Coal or similar liquefiable carbonaceous solids are converted into hydrocarbon liquids by contacting the feed solids with molecular hydrogen in the absence of an added hydrocarbon solvent and in the presence of an added alkali metal compound under liquefaction conditions in one or more liquefaction zones.

28 Claims, 1 Drawing Figure

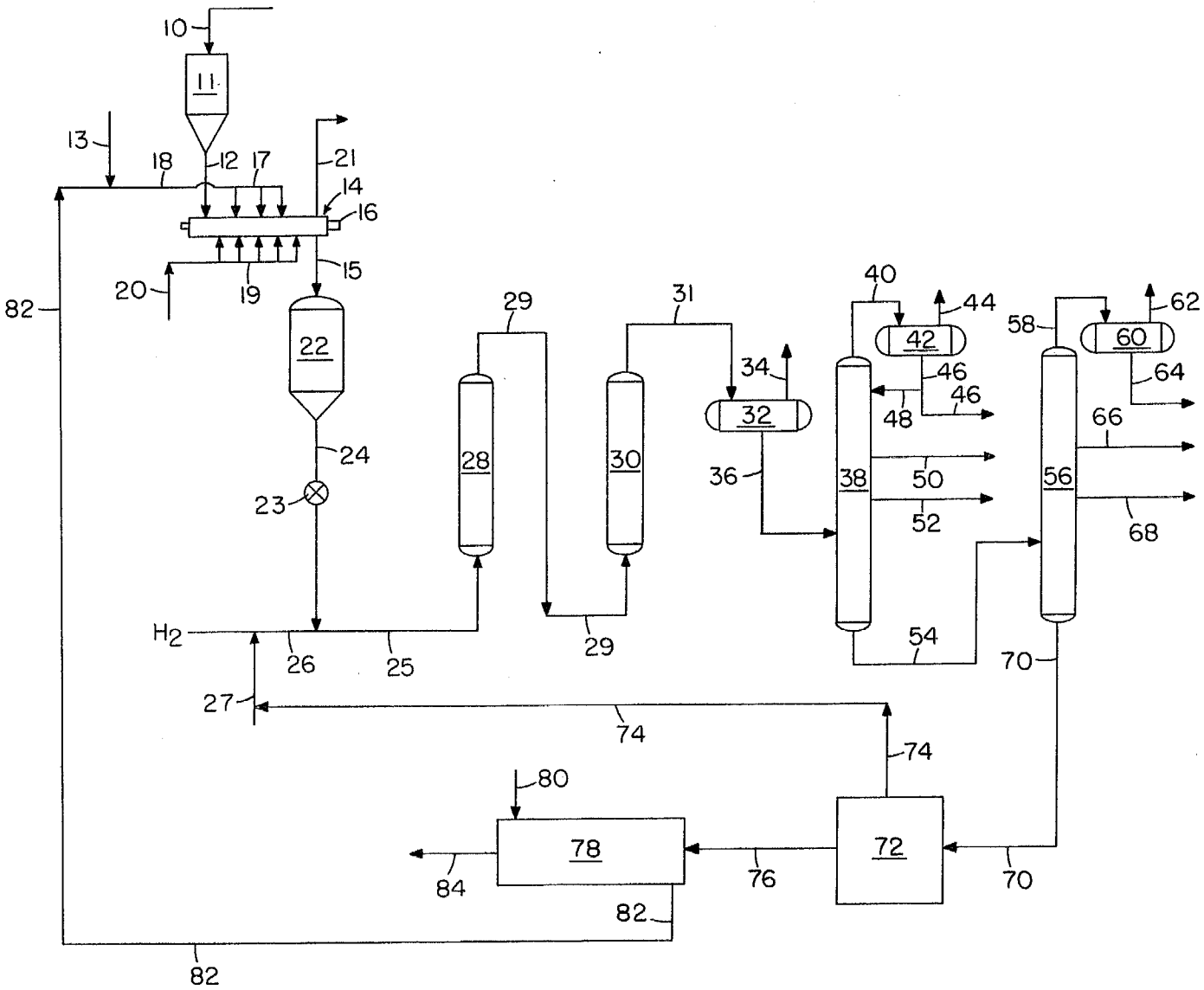
10
11
12
13
14
15
16
17
18
19
20
21
22
23
24
25
26
27
28
29
30
31
32
34
36
38
40
42
44
46
48
50
52
54
56
58
60
62
64
66
68
70
72
74
76
78
80
82
84
H2

COAL CONVERSION IN THE PRESENCE OF ADDED ALKALI METAL COMPOUNDS

BACKGROUND OF THE INVENTION

This invention relates to the conversion of coal and similar carbonaceous solids into liquids and is particularly concerned with a coal conversion process carried out in the absence of an externally added hydrocarbon solvent.

Processes for the conversion of coal and similar carbonaceous solids into hydrocarbon liquids normally require contacting of the solid feed material with a hydrocarbon solvent and molecular hydrogen at elevated temperature and pressure to break down the complex high molecular weight starting material into lower molecular weight hydrocarbon liquids and gases. The most promising processes of this type are those carried out with a hydrogen-donor solvent which gives up hydrogen atoms for reaction with organic radicals liberated from the coal or other feed material during the conversion or liquefaction step. In such a process a portion of the liquids produced in the liquefaction reactor are recovered and catalytically hydrogenated in a solvent hydrogenation reactor to generate the hydrogen-donor solvent required in the liquefaction step. The heavy liquefaction product, which normally boils in excess of about 1000° F., recovered from the liquefaction reactor may be upgraded by subjecting it to pyrolysis to produce gases, additional hydrocarbon liquids, and coke which is subsequently steam gasified to form hydrogen and carbon monoxide for use as fuel.

Although hydrogen-donor liquefaction has numerous advantages over other liquefaction processes and produces a relatively large amount of liquids, it does require the use of a donor solvent produced by hydrogenating a portion of liquid product in an external catalytic hydrogenation reactor. The production of this hydrogen-donor recycle solvent stream via catalytic hydrogenation external to the liquefaction step adds appreciably to the cost of the process and it would therefore be economically attractive if the recycle stream could be eliminated without substantially decreasing the liquid yield from the process.

SUMMARY OF THE INVENTION

The present invention provides an improved process for converting coal or similar liquefiable carbonaceous solids into liquid hydrocarbons which at least in part alleviates the difficulties referred to above. In accordance with the invention, it has now been found that high yields of liquid products can be obtained from coal such as bituminous coal, subbituminous coal and lignite, or similar solid carbonaceous feed materials without the use of an added hydrocarbon solvent or other added liquid diluent by contacting the feed solids with molecular hydrogen in a liquefaction zone under liquefaction conditions in the absence of externally added hydrocarbon liquids and in the presence of an added alkali metal compound, preferably sodium or potassium carbonate or hydroxide. Normally, water is not added to the liquefaction zone and the only water present in the zone will be the moisture which enters the liquefaction zone as part of the carbonaceous feed material and the water produced in situ during liquefaction. In general, the carbonaceous feed solids will contain less than about 30 weight percent water. The residence time of the feed solids in the liquefaction zone will normally range between about 20 and about 120 minutes, preferably between about 40 and about 90 minutes. In general, the liquefaction zone is operated at a temperature between about 790° F. and about 900° F., preferably between about 800° F. and about 860° F. The pressure in the liquefaction zone will normally range between about 300 psig and about 5000 psig, preferably between about 1500 psig and about 2500 psig. A sufficient amount of an alkali metal compound is normally added to the liquefaction zone to provide between about 2 weight percent and about 30 weight percent of the alkali metal based on the weight of moisture and ashfree carbonaceous solids fed to the liquefaction zone. Preferably, the amount of alkali metal compound added to the liquefaction zone will be sufficient to provide between about 3 weight percent to about 10 weight percent of the alkali metal.

In the preferred embodiment of the invention, the carbonaceous feed solids are contacted with molecular hydrogen under liquefaction conditions in the absence of externally added hydrocarbon liquids and in the presence of an added alkali metal compound during sequential residence in two or more liquefaction zones arranged in series and operated such that the temperature in each zone increases from the first to the final zone of the series and the total of the residence times in all except the final zone of the series is sufficient to produce an increase in liquid yield over that obtainable by single stage liquefaction carried out under the conditions in the final zone. The effluent from each liquefaction zone excluding the final zone is passed to the next succeeding zone of higher temperature. In this manner the feed solids that are not liquefied or converted into lower molecular weight liquids in the initial zone are at least partially liquefied in the second zone, the unconverted solids in the effluent from the second zone are at least partially liquefied in the third zone, and so forth until the final zone is reached. Here the remaining unconverted solids are subjected to a relatively high temperature, preferably greater than about 790° F., for maximum conversion of solids into liquids. The effluent from the last liquefaction zone is then treated to recover liquid hydrocarbonaceous products. Normally, no hydrocarbon liquids are added with the feed solids to the first liquefaction zone in the series and the only liquids introduced into each subsequent zone in the series are the liquids in the effluent from the preceding liquefaction zone. In addition, no water is normally added to any of the liquefaction zones except for the moisture that may be present in the carbonaceous feed material introduced into the first liquefaction zone and the water in the effluent from each liquefaction zone that is passed to the next succeeding zone.

In the multizone embodiment of the invention, as many liquefaction zones as are economically viable may be utilized. In the most preferred embodiment of the invention, however, only two zones are used. The carbonaceous feed solids are contacted with molecular hydrogen in the absence of externally added hydrocarbon liquids and in the presence of an added alkali metal compound under liquefaction conditions in the first liquefaction zone and the effluent from the first zone is subsequently subjected to liquefaction conditions in the presence of molecular hydrogen and an alkali metal compound in the second liquefaction zone, which is maintained at a temperature greater than the temperature in the firt liquefaction zone. Normally, the only liquids added to the second liquefaction zone are the liquids produced in the first liquefaction zone. Unconverted high molecular weight constituents from the first liquefaction zone are further converted into lower molecular weight liquids in the second liquefaction zone. A liquid hydrocarbonaceous product is recovered from the effluent of the second zone. Preferably, the temperature in the second zone is between about 80° F. and about 150° F. greater than the temperature in the first zone. The residence time utilized in the first liquefaction zone will normally be greater, preferably between about 20 minutes and about 100 minutes greater, than the residence time in the second zone.

The process of the invention results in an increase in the amount of hydrocarbon liquids produced from coal by single stage liquefaction in the absence of an added hydrocarbon solvent. Furthermore, the process of the invention substantially increases the amount of liquids produced by staged temperature liquefaction of coals in the absence of an added hydrocarbon solvent, and in some cases results in liquid yields only slightly below those obtained by single stage liquefaction carried out in the presence of an added hydrogen-donor solvent. In addition, the process of the invention results in the conversion of coal and other carbonaceous solids into liquids having a higher hydrogen content as compared to those obtainable by liquefaction in the absence of both a hydrocarbon solvent and an added alkali metal compound.

BRIEF DESCRIPTION OF THE DRAWING

The drawing is a schematic diagram of a staged temperature coal conversion process for producing liquid products from coal carried out in accordance with the invention.

DESCRIPTION OF THE PREFERRED EMBODIMENTS

In the process depicted in the drawing, the solid carbonaceous feed material is introduced into the system through line 10 from a preparation plant, not shown, in which the coal or other feed material may be crushed, dried, and screened or from a storage facility which does not appear in the drawing. To facilitate handling of the solid feed material in the process, the coal or other carbonaceous solid is introduced into the system in a finely divided state, normally less than about 8 mesh on the U.S. Sieve Series Scale. The feed material employed in the process will normally consist of solid particles of bituminous coal, subbituminous coal, lignite, brown coal, or a mixture of two or more such materials. In lieu of coal other carbonaceous solids may be employed. Such materials include oil shale, organic waste material, liquefaction bottoms and the like.

The carbonaceous solids introduced through line 10 are fed into a hopper or similar vessel 11 from which they are passed through line 12 into feed preparation zone 14. This zone contains an enclosed screw conveyor or similar device, not shown in the drawing, that is powered by motor 16, a series of spray nozzles or similar devices 17 for the spraying of an alkali metal-containing solution supplied through line 18 onto the solids as they are moved through the preparation zone by the conveyor, and a similar set of nozzles or the like 19 for the introduction of steam into the preparation zone. The steam, supplied through line 20, serves to heat the impregnated solids through indirect heat exchange and drive off the moisture. The steam is withdrawn from the feed preparation zone through line 21 and passed to a condenser, not shown, from which it may be recovered for use as makeup water or the like. The alkali metal-containing solution is in part injected into line 18 through line 13 with the remainder being recycled through line 82 from the alkali metal recovery section of the process which is described in detail hereinafter.

Any of a variety of alkali metal compounds may be used in preparing the aqueous solution injected into line 18 through line 13. Suitable compounds include alkali metal carbonates, bicarbonates, formates, oxalates, hydroxides, sulfides, nitrates, sulfites, acetates and mixtures of these and other similar compounds. All of these are not equally effective as a catalyst and hence certain alkali metal compounds can be expected to give a somewhat better result under certain conditions than do others. In general, cesium, potassium, sodium and lithium salts derived from organic or inorganic acids having ionization constants less than about $1\times10^{-3}$ and alkali metal hydroxides are preferred. The cesium compounds are the most effective followed by the potassium, sodium, and lithium compounds in that order. Because of their high activity, relatively low cost compared to cesium compounds and ready availability, potassium compounds or sodium compounds are generally employed. Potassium carbonate and potassium hydroxide are especially effective.

It is preferred that sufficient alkali metal-containing solution be introduced into feed preparation zone 14 to provide from about 2 to about 30 weight percent of the alkali metal itself on the coal or other carbonaceous solids. From about 3 to about 10 weight percent is generally adequate. The dried impregnated solid particles prepared in zone 14 are withdrawn through line 15 and passed to closed hopper or similar vessel 22. From here they are discharged through star wheel feeder or equivalent device 23 in line 24 at an elevated pressure sufficient to permit their entrainment into a stream of high pressure hydrogen or hydrogen-containing gas introduced into line 25 via line 26. The majority of the hydrogen in line 26 is recovered or produced in downstream steps of the process and recycled to line 26 through line 27. The mixture of hydrogen and entrained solids will normally contain from about 4 to about 30 weight percent, preferably from about 6 to about 20 weight percent, of hydrogen on a moisture and ash-free solids basis. The mixture is passed through line 25 into the bottom of first stage liquefaction reactor 28. Normally, no liquid phase or vapor phase hydrocarbon solvent is added to the liquefaction reactor with the entrained solids. Furthermore, no water is normally added to the reactor with the solids except that water which remains in the carbonaceous feed material that exits feed preparation zone 14. In general, the carbonaceous material exiting preparation zone 14 will contain between about 0.1 and about 5 weight percent water. In lieu of or in addition to hopper 22 and star wheel feeder 23, the feed system may employ parallel lock hoppers, pressurized hoppers, aerated standpipes operated in series, or other apparatus to raise the input feed solid stream to the required pressure level. The aqueous impregnation which takes place in zone 14 tends to destroy the caking and agglomeration properties of the carbonaceous feed material and facilitates its transfer through the feed system into reactor 28 without the use of a liquid carrier.

The carbonaceous feed solids impregnated with the alkali metal compound or compounds and entrained in hydrogen are subjected to temperatures of at least 650° F., normally between about 680° F. and about 750° F., and preferably between about 690° F. and about 720° F. as they pass upwardly with the hydrogen through liquefaction reactor 28. The pressure in the reactor is maintained between about 300 psig and about 5000 psig, preferably between about 1500 psig and about 2500 psig. The residence time of the solids which pass through the first stage reactor 28 will normally be above about 40 minutes and will preferably range from about 60 minutes to about 200 minutes. A residence time between about 120 minutes and about 170 minutes appears to be the most preferable.

Within liquefaction reactor 28, the feed solids undergo liquefaction or chemical conversion into lower molecular weight constituents. The high molecular weight constituents of the carbonaceous feed solids are broken down and hydrogenated to form lower molecular weight gases and liquids. The hydrogen injected with the feed particles gives up hydrogen atoms that react with organic radicals liberated from the particles to stabilize them and thereby prevent their recombination. The alkali metal compound or compounds present in the feed solids promotes the direct hydrogenation of the coal structure and the organic radicals generated by the cracking of coal molecules thereby increasing the amount of liquids produced and at the same time producing more saturated liquids having a higher hydrogen content and a lower boiling point than would otherwise be the case. Normally, between about 0.5 and about 4 weight percent hydrogen based on moisture and ash-free feed solids is consumed during the passage of the solids through the liquefaction reactor.

The effluent from first stage liquefaction reactor 28, which contains gaseous liquefaction products such as carbon monoxide, carbon dioxide, ammonia, hydrogen, hydrogen sulfide, methane, ethane, ehtylene, propane, propylene and the like, unreacted hydrogen, light liquids, heavier liquefaction products including mineral matter, unconverted feed solids, high molecular weight liquids and alkali metal compounds is withdrawn from the top of the reactor through line 29 and passed to second stage liquefaction reactor 30. Normally, all of the liquids, unconverted carbonaceous solids and mineral matter from reactor 28 are passed into reactor 30. The only hydrocarbon liquids injected into reactor 30 will be those produced in reactor 28. The only water injected into reactor 30 will be the water produced in reactor 28 plus the water originally in the coal or other carbonaceous material fed to reactor 28. Hydrocarbon liquids and water from any other source are normally not added to reactor 30.

In second stage liquefaction reactor 30, the effluent from the first stage liquefaction reactor 28 is subjected to further liquefaction at a temperature greater than the temperature in reactor 28, normally at a temperature between about 790° F. and about 900° F., preferably between about 820° F. and about 860° F. The pressure in the reactor will normally be maintained between about 300 psig and about 5000 psig, preferably between about 1500 psig and about 2500 psig. The solids residence time within the second stage reactor 30 will normally range between about 20 minutes and about 120 minutes and will preferably be between about 40 minutes and about 90 minutes. In general, sufficient hydrogen will be in the feed to the second stage reactor to provide from about 4 to about 30 weight percent, preferably from about 6 to about 20 weight percent, hydrogen based upon the moisture and ash-free solids fed to the first liquefaction reactor. Essentially all of the alkali metal compound or compounds impregnated onto the feed material in feed preparation zone 14 will pass through reactor 28 into reactor 30. Although reactors 28 and 30 are described as plug flow reactors, it will be understood that any type of reactor which will allow contact of the feed material and hydrogen under the specified temperature and pressure conditions for the required amount of time can be utilized. Such reactors include a moving bed reactor, an autoclave, a fluidized bed reactor and the like.

The reactions taking place in the liquefaction zone in second stage reactor 30 are similar to those which occur in first stage liquefaction reactor 28. The unconverted feed solids and high molecular weight constituents are broken down or cracked and hydrogenated to form lower molecular weight gases and liquids. Molecular hydrogen in the gas phase gives up hydrogen atoms that react with organic radicals formed when the unconverted feed solids and high molecular weight constitutents are cracked, thereby preventing their recombination and producing gases and lower molecular weight liquids. The alkali metal compound or compounds present in the liquefaction zone serve to promote the reaction of the hydrogen atoms with the liberated organic radicals and also serve to promote the direct hydrogenation of the coal structure. This, in turn, results in a greater production of liquids which contain more saturates and a higher hydrogen content, and are lower boiling than the liquids normally produced by liquefaction in the absence of both a hydrocarbon solvent and an added alkali metal compound or compounds. Normally, between about 1 weight percent and about 6 weight percent hydrogen, based upon the moisture and ash-free solids fed to the first liquefaction reactor 28, is consumed during passage of the reactants through second stage liquefaction reactor 30.

In conventional coal liquefaction operations, coal is normally slurried with a hydrogen-donor solvent and then contacted with hydrogen in a liquefaction zone operated above 800° F. A portion of the liquid product produced in the liquefaction zone is then subjected to catalytic hydrogenation in a hydrogenation zone external to the liquefaction zone to regenerate the hydrogen-donor solvent which is then recycled to the process. The external hydrogenation of the coal liquids produced in the liquefaction zone and the recycle of the resultant hydrogen-donor solvent adds appreciably to the cost of the overall liquefaction process. It has previously been found that liquid yields approaching those obtained in conventional hydrogen-donor liquefaction processes can be obtained without the use of either a vapor phase of liquid phase hydrogen-donor solvent by subjecting certain types of coal or similar solid carbonaceous feed materials in particular size ranges to liquefaction in a plurality of liquefaction zones arranged in series and operated such that the temperature in each zone increases from the first to the final zone in the series. Normally, the total of the residence times in all except the final zone of the series is greater than the residence time in the final zone. No hydrocarbon liquids are added to the first zone in the series and the only hydrocarbon liquids present in that zone are those generated in situ. Any hydrocarbon liquids present in each succeeding zone in the series are liquids produced in the preceding zones that are passed into that zone.

It has now been found that this process of staged temperature liquefaction in the absence of a liquid phase or vapor phase hydrocarbon solvent can be substantially improved by carrying out the process in the presence of an added alkali metal compound. "Added alkali metal compound" as used herein refers only to an alkali metal compound which is added to the liquefaction zone and is not a naturally occurring part of the carbonaceous feed material. It has been found that for certain types of feed materials, the addition of an alkali metal compound will significantly increase the liquid yields obtainable in the overall staged temperature liquefaction process. Furthermore, it has been found that the addition of the alkali metal compound in the reaction zones of the process will result in the conversion of coal and other carbonaceous feed material into liquids which contain a higher hydrogen content, more saturates and a greater amount of lower boiling components than liquids obtainable without the use of the alkali metal compound. It has also been found that the above advantages also exist when the single stage liquefaction of coal or similar carbonaceous materials in the absence of an added hydrocarbon solvent is carried out in the presence of an added alkali metal compound. It is believed that the increase in liquid yields and the production of liquids containing more hydrogen is due to the fact that the alkali metal compounds serve as a catalyst for the hydrogenation of the coal or similar carbonaceous feed material in the absence of a hydrocarbon solvent. It is not known at this time why alkali metal compounds appear effective in the absence of a solvent but have minimal catalytic effect in a liquefaction process carried out in the presence of a solvent.

Referring again to the drawing, the effluent from the second stage liquefaction reactor 30 is withdrawn from the top of the reactor through line 31 and passed to separator 32. Here the reactor effluent is separated, preferably at substantial liquefaction pressure, into an overhead vapor stream that is withdrawn through line 34 and a liquid stream recovered through line 36. The overhead vapor stream is passed to downstream units where the ammonia, hydrogen, hydrogen sulfide and carbon dioxide are separated from the low molecular weight gaseous hydrocarbons, which are recovered as valuable byproducts. The hydrogen recovered from the vapor stream is recycled to the process through line 27 for reuse in the liquefaction reactors. Some of the light hydrocarbons, such as methane and ethane, may be steam reformed to produce hydrogen that can also be recycled through line 27 or used elsewhere in the process where required.

The liquid stream removed from separator 32 through line 36 will normally contain low molecular weight liquids, high molecular weight liquids, mineral matter, unconverted coal and alkali metal residues. This stream is passed through line 36 into atmospheric distillation column 38 where the separation of low molecular weight liquids from the high molecular weight liquids boiling above about 1000° F. and solids is begun. In the atmospheric distillation column, the feed is fractionated and an overhead fraction composed primarily of gases and naphtha constituents boiling up to about 400° F. is withdrawn through line 40, cooled, and passed to distillate drum 42 where the gases are taken off overhead through line 44. This gas stream may be employed as fuel gas for generation of process heat, steam reformed to produce hydrogen that may be recycled to the process where needed, or used for other purposes. Liquids are withdrawn from distillate drum 42 through line 46 and a portion of the liquids may be returned as reflux through line 48 to the upper portion of the distillation column. The remaining naphtha is recovered as product. An intermediate liquid fraction boiling below about 500° F. is withdrawn as product through line 50 and a heavier intermediate fraction composed primarily of constituents boiling below about 700° F. is withdrawn as product through line 52. The bottoms from the distillation column, composed primarily of constituents boiling in excess of 700° F., is withdrawn through line 54, heated to a temperature between about 600° F. and 775° F., and introduced into vacuum distillation column 56.

In the vacuum distillation column, the feed is distilled under reduced pressure to permit the recovery of an overhead fraction that is withdrawn through line 58, cooled and passed to distillate drum 60. Gases are removed from the distillate drum via line 62 and may either be used as fuel, passed to a steam reformer to produce hydrogen for recycling to the process where needed, or used for other purposes. Light liquids are withdrawn from the distillate drum through line 64 and recovered as product. A heavier intermediate fraction, composed primarily of constituents boiling below about 850° F., may be withdrawn from the vacuum distillation tower through line 66 and a still heavier sidestream may be withdrawn through line 68. The bottoms from the vacuum distillation column, which consists primarily of high molecular weight liquids boiling above 1000° F., mineral matter, unconverted coal and alkali metal residues is withdrawn through line 70. This heavy liquefaction bottoms product contains a substantial amount of carbon and is normally further converted to recover liquids and/or gases.

The heavy liquefaction bottoms removed from atmospheric distillation column 56 through line 70 is passed to the bottoms conversion process designated by box 72 in the drawing. Although any of a variety of conversion processes may be used on the heavy liquefaction bottoms including partial oxidation, it is normally preferred to first pyrolyze the bottoms in a fluidized bed coker to produce liquids, which can be recovered as product, and to form coke with the alkali metal residues incorporated therein. The resultant coke is then passed to a fluidized bed gasifier where it is reacted with steam in the presence of an oxygen-containing gas. Such a conversion process is described in detail in U.S. Pat. Nos. 4,060,478 and 4,048,054, the disclosures of which are hereby incorporated by reference. The liquids produced in the coker may be removed and recovered as product. The mixture of hydrogen and carbon monoxide produced by the reaction of steam with carbon during the gasification of the coke is withdrawn overhead of the gasifier and separated into a hydrogen stream and a carbon monoxide stream. The hydrogen thus produced is passed through line 74 into line 27 for use as hydrogen in the liquefaction process. The carbon monoxide produced may be withdrawn and used as fuel where needed in the process. The alkali metal residues in the coke being gasified will serve to catalyze the gasification reactions thereby making it possible to carry out the reactions at a lower temperature in smaller equipment.

The char produced during gasification contains alkali metal residues which may be recovered and reused as at least a portion of the alkali metal compound or mixture of compounds required in liquefaction reactors 28 and 30, thereby reducing the amount of alkali metal compound that must be introduced into the system in solution form through line 13. The char containing the alkali metal residues produced in the gasifier is passed through line 76 to alkali metal recovery unit 78. The recovery unit will normally comprise a multistage, countercurrent leaching system in which the high ash content char particles containing alkali metal constituents are countercurrently contacted with water introduced through line 80. The first stage of the alkali metal recovery unit may utilize calcium hydroxide digestion to convert water-insoluble alkali metal constituents into water-soluble constituents. Such a digestion step is described in detail in U.S. Pat. No. 4,159,195, the disclosure of which is herein incorporated by reference. An aqueous solution of alkali metal compounds is withdrawn from the unit through line 82 and recycled through lines 18 and 17 to feed preparation zone 14. Char residues from which soluble alkali metal compounds have been leached are withdrawn from the recovery unit through line 84 and may be disposed of as landfill or used for other purposes.

In the embodiment of the invention described above and shown in the drawing, the alkali metal compound or compounds utilized in the liquefaction zones of the process are dissolved in water to form an aqueous solution which is sprayed onto the feed material and the resultant wetted feed material is then dried thereby impregnating the alkali metal compound or compounds into the feed material. It will be understood that this is not the only method of introducing the alkali metal compound or compounds into the liquefaction reactors. For example, the alkali metal compound or compounds could be mixed in dry form with the solid feed material in hopper 22 and the resultant mixture passed through the liquefaction reactors. Alternatively, the alkali metal compound or compounds may be separately introduced into reactors 28 and 30.

The nature and objects of the invention are further illustrated by the results of laboratory tests which indicate that the liquid yields obtained from the liquefaction of a bituminous coal in a single or staged temperature liquefaction operation carried out in the absence of an added solvent are increased substantially by the addition of an alkali metal compound. These tests also show that hydrogen consumption during the liquefaction of coal in a single stage or multiple stage system in the absence of an added hydrogen-donor solvent is significantly increased thereby producing liquids that may be of a higher quality than are normally obtainable without the use of an added alkali metal compound.

The laboratory tests were conducted as follows. Stainless steel tubing bombs having a volume between 35 and 37 milliliters were charged with 3 grams of either Illinois No. 6 bituminous coal or Wyodak subbituminous coal that was ground and screened so that the particles of coal varied in size from −30 mesh to 100 mesh on the U.S. Sieve Series Scale. No hydrocarbon solvent was added to the bombs. The only water added to the bombs was the moisture content of the coal fed to the tubing bombs. Sufficient hydrogen was injected into the bombs to produce a pressure of 1000 psig at 75° F. When potassium carbonate was used it was impregnated onto the coal from an aqueous solution prior to charging the coal into the tubing bombs. The impregnation was carried out by wetting the coal with an aqueous solution of potassium carbonate and then drying the coal in a vacuum oven. The bombs were agitated at 120 cycles per minute for 60 minutes in a fluidized sand bath heated to a temperature sufficient to provide a temperature of 840° F. in the bombs. After agitation, the bombs were cooled to room temperature and a final pressure was recorded. Gases were bled off overhead of the bombs, measured by glass bomb water displacement and analyzed by gas chromatography. A slurry comprising high molecular weight carbonaceous particles and mineral matter suspended in liquid hydrocarbons was recovered for each bomb. Each slurry was washed by mixing it for 5 minutes with 10 times its weight in cyclohexane. The mixture was then centrifuged for 15 minutes at a speed of 2000 rpm. The upper layer, which was rich in cyclohexane, was decanted and the remaining bottom layer was remied with cyclohexane and washed again as described above. This washing procedure was performed a total of 5 times. The amount of solid residue from each bomb that did not dissolve in the cyclohexane was measured. The amount of liquids produced in each bomb was then determined by subtracting the sum of the amount of gas and solids produced from the sum of 100 and the amount of hydrogen consumed. The resultant number represents the amount of both hydrocarbon liquids and water that was produced. The water make was not measured directly but was calculated from the pressure readings taken during each run. From the pressure data, it is reasonable to assume that about 5 weight percent water was produced in each run with Illinois No. 6 coal and about 8 weight percent water was produced in each run with Wyodak coal. The staged temperature runs were carried out in the manner described above except that the initial temperature of the tubing bombs was maintained at 700° F. for a period of 150 minutes after which the tubing bombs were removed from the sand bath and placed in a second sand bath maintained at a temperature sufficient to increase the temperature in the tubing bombs to 840° F. This temperature was maintained for a period of 60 minutes. The tubing bombs were then cooled and the same procedure as described above was followed to analyze the products produced during liquefaction. The results of these tests are set forth in Table I below.

TABLE I

EFFECT OF POTASSIUM CARBONATE ON COAL LIQUEFACTION IN THE ABSENCE OF A HYDROCARBON SOLVENT

| | | Single Stage** | | | | Staged Temperature*** | | | |
|---|---|---|---|---|---|---|---|---|---|
| Coal | $K_2CO_3$ Loading Wt % Dry Coal | Gases* | Liquids*+ | Bottoms* | Hydrogen Consumed* | Gases* | Liquids*+ | Bottoms* | Hydrogen Consumed* |
| Ill No. 6 | — | 8.2 | 22 | 71 | 1.3 | 8.3 | 27 | 66 | 2.0 |
| Ill No. 6 | 15 | 9.8 | 28 | 63 | 2.3 | 8.3 | 33 | 61 | 2.3 |
| Wyodak | — | 12.8 | 25 | 64 | 1.6 | 11.6 | 29 | 62 | 2.0 |

TABLE I-continued

EFFECT OF POTASSIUM CARBONATE ON COAL LIQUEFACTION IN THE ABSENCE OF A HYDROCARBON SOLVENT

| Coal | $K_2CO_3$ Loading Wt % Dry Coal | Single Stage** | | | | Staged Temperature*** | | | |
|---|---|---|---|---|---|---|---|---|---|
| | | Gases* | Liquids*+ | Bottoms* | Hydrogen Consumed* | Gases* | Liquids*+ | Bottoms* | Hydrogen Consumed* |
| Wyodak | 15 | 12.8 | 23 | 66 | 2.1 | 11.6 | 27 | 64 | 2.2 |

*All values in wt. % dry coal
**Single stage operated at 840° F. with a solids residence time of 60 minutes
***First stage operated at 700° F. with a solids residence time of 150 minutes; second stage operated at 840° F. with a solids residence time of 60 minutes
+Liquid yield includes water and is equal to [(100 + $H_2$ consumed) − (bottoms + gases)]

As can be seen from Table I, the presence of potassium carbonate increases liquid yield about 6 weight percent for both single stage and staged temperature liquefaction of Illinois No. 6 coal in the absence of an added hydrocarbon solvent. The data for Illinois No. 6 coal also indicate that the amount of hydrogen consumed in both single stage and staged temperature liquefaction is increased by the presence of the potassium carbonate. This increase in hydrogen consumption indicates that the liquids produced will contain a greater amount of saturates and lower boiling constituents, and will have a higher hydrogen content than liquids obtainable in the absence of added potassium carbonate. Thus, the resultant liquids may be of a high quality and therefore easily marketable.

The data in Table I indicate that potassium carbonate does not increase liquid yields from single stage and staged temperature liquefaction in the absence of an externally added hydrocarbon solvent when Wyodak coal is liquefied. The data, however, do show that hydrogen consumption increases in both single stage and staged temperature liquefaction of Wyodak coal and thus, like the case for Illinois No. 6, the presence of potassium carbonate in the liquefaction zone or zones apparently results in the production of high quality liquids. In general, it is believed that an alkali metal compound such as potassium carbonate will increase liquid yields obtainable from liquefaction of higher rank coals, particularly bituminous coals, and that it will have little effect on lower rank coals, particularly subbituminous coals. The presence of the alkali metal compound, however, will increase the hydrogen consumed during liquefaction of both low and high rank coals. This, in turn, strongly indicates that the resultant liquids are of higher quality than those that can be obtained without the use of the alkali metal compound.

It will be apparent from the preceding discussion that the invention provides an improved process for converting coal and similar solid carbonaceous feed materials into liquid products. The process encompasses the use of an alkali metal compound to upgrade the quality of the liquids produced and at the same time to increase liquid yields from certain types of feed material.

We claim:

1. A process for converting coal or similar liquefiable carbonaceous solids into liquid hydrocarbons which comprises contacting said carbonaceous solids with molecular hydrogen under liquefaction conditions in a liquefaction zone in the presence of an added alkali metal compound, and in the absence of externally added hydrocarbon liquids and externally added water other than the inherent moisture in said carbonaceous solids.

2. A process as defined in claim 1 wherein the residence time of said carbonaceous solids in said liquefaction zone is between about 20 and about 120 minutes.

3. A process as defined in claim 2 wherein said carbonaceous solids comprise a bituminous coal.

4. A process as defined in claim 1 wherein said alkali metal compound is a sodium or potassium compound.

5. A process as defined in claim 4 wherein said alkali metal compound comprises sodium carbonate, potassium carbonate, sodium hydroxide, or potassium hydroxide.

6. A process as defined in claim 1 wherein a sufficient amount of said alkali metal compound is introduced into said liquefaction zone to produce an alkali metal concentration of between about 2 weight percent and about 30 weight percent based on the weight of the moisture and ash-free carbonaceous solids.

7. A process as defined by claim 1 wherein said carbonaceous solids are contacted with molecular hydrogen in the absence of an externally added vapor phase hydrocarbon solvent.

8. A process as defined by claim 1 wherein the temperature in said liquefaction zone is between about 790° F. and about 900° F.

9. A process as defined by claim 1 wherein the pressure in said liquefaction zone is between about 300 psig and about 5000 psig.

10. A process as defined by claim 5 wherein said carbonaceous solids comprise a bituminous coal.

11. A process for converting coal or similar liquefiable carbonaceous solids into liquid hydrocarbons which comprises:

(a) contacting said carbonaceous solids with molecular hydrogen in the presence of an added alkali metal compound, and in the absence of externally added hydrocarbon liquids and externally added water other than the inherent moisture in said carbonaceous solids under liquefaction conditions during sequential residence in two or more liquefaction zones arranged in series and operated such that (i) the temperature in each zone increases from the first to the final zone of the series, and (ii) the total of the solids residence times in all except the final zone of the series is sufficient to produce an increase in liquid yield over that which would be obtainable by a single stage liquefaction carried out under the conditions in said final zone, wherein said carbonaceous solids are partially converted into liquid hydrocarbons in each of said liquefaction zones and the only hydrocarbon liquids and water added to each liquefaction zone subsequent to said first liquefaction zone are the hydrocarbon liquids and water in the effluent from the preceding liquefaction zone; and (b) recovering liquid hydrocarbonaceous product from the effluent of said final liquefaction zone.

12. A process as defined in claim 11 wherein said carbonaceous solids comprise a bituminous coal.

13. A process as defined in claim 11 wherein said alkali metal compound comprises sodium or potassium carbonate, bicarbonate, hydroxide, sulfide, sulfite, nitrate, formate, or oxalate.

14. A process as defined in claim 11 wherein the total of the solids residence times in all except the final zone of the series is greater than about 40 minutes.

15. A process as defined in claim 11 wherein said first liquefaction zone is operated at a temperature in the range between about 680° F. and 750° F. and the solids residence time in said first liquefaction zone is between about 60 minutes and about 200 minutes.

16. A process as defined in claim 11 wherein said final liquefaction zone is operated at a temperature between about 790° F. and about 900° F. and the solids residence time in said final liquefaction zone is between about 20 minutes and about 120 minutes.

17. A process as defined in claim 11 wherein two liquefaction zones are employed in step (a).

18. A process as defined in claim 11 wherein a sufficient amount of said alkali metal compound is added to said first liquefaction zone to provide an alkali metal concentration in all of said zones of between about 2 and about 30 weight percent based on the weight of the moisture and ash-free solids fed to said first zone.

19. A process as defined by claim 11 wherein the temperature in said first liquefaction zone is between about 680° F. and about 750° F., and the temperature in said final liquefaction zone is greater than about 790° F.

20. A process as defined by claim 11 wherein the pressure in all of said liquefaction zones is between about 300 psig and about 5000 psig.

21. A process as defined by claim 13 wherein said carbonaceous solids comprise a bituminous coal.

22. A process for converting coal into liquid hydrocarbons which comprises:

(a) contacting said coal with molecular hydrogen at a temperature above about 650° F. and at a pressure between about 300 psig and about 5000 psig in the presence of added potassium carbonate or potassium hydroxide, and in the absence of externally added hydrocarbon liquids and externally added water other than the inherent moisture in said coal in a first liquefaction zone to at least partially convert said coal into liquid hydrocarbons thereby producing a liquefaction effluent, wherein the residence time of said coal in said liquefaction zone is above about 40 minutes;

(b) subjecting said liquefaction effluent from said first liquefaction zone to a temperature above about 790° F. and to a pressure between about 300 psig and about 5000 psig in the presence of molecular hydrogen and potassium hydroxide or potassium carbonate in a second liquefaction zone maintained at a temperature greater than the temperature in said first liquefaction zone thereby further converting said coal into liquid hydrocarbons, wherein the only hydrocarbon liquids and water added to said second liquefaction zone are the hydrocarbon liquids and water in said liquefaction effluent from said first liquefaction zone; and (c) recovering liquid hydrocarbonaceous products from the effluent of said second liquefaction zone.

23. A process as defined in claim 22 wherein said coal comprises a bituminous coal.

24. A process as defined in claim 22 wherein said residence time in said first liquefaction zone is between about 120 minutes and about 170 minutes and said residence time in said second liquefaction zone is between about 40 minutes and about 90 minutes.

25. A process as defined in claim 22 wherein the temperature in said first liquefaction zone is between about 690° F. and about 720° F. and the temperature in said second liquefaction zone is between about 820° F. and about 860° F.

26. A process as defined in claim 22 wherein a sufficient amount of potassium hydroxide or potassium carbonate is added to said first liquefaction zone to provide a potassium concentration in said first and said second liquefaction zones of between about 2 and about 30 weight percent based on the weight of the moisture and ash-free solids fed to said first liquefaction zone.

27. A process as defined by claim 22 wherein said residence time of said coal in said first liquefaction zone is greater than the solids residence time in said second liquefaction zone.

28. A process as defined by claim 22 wherein the solids residence time in said second liquefaction zone is between about 20 minutes and about 120 minutes.

* * * * *